United States Patent [19]

Toncelli

[11] Patent Number: 4,914,870

[45] Date of Patent: Apr. 10, 1990

[54] PROCESS FOR AUTOMATICALLY SMOOTHING AND POLISHING SLABS OR MARBLE, GRANITE, STONES AND THE LIKE

[76] Inventor: Marcello Toncelli, Via Giovanni XXIII, 2, Bassano del Grappa, Vicenza, Italy

[21] Appl. No.: 241,507

[22] Filed: Sep. 7, 1988

[30] Foreign Application Priority Data

Sep. 15, 1987 [IT] Italy ..... 85600 A/87

[51] Int. Cl.[4] ..... B24B 7/06; B24B 7/22

[52] U.S. Cl. ..... 51/283 R; 125/27; 125/28; 51/34 C; 51/45; 51/56 R

[58] Field of Search ..... 51/34 C, 45, 56 R, 283 R; 125/27, 28

[56] References Cited

U.S. PATENT DOCUMENTS 1,732,695 10/1929 Platt ..... 51/56 R

*Primary Examiner*—Judy Hartman
*Assistant Examiner*—Jack W. Lavinder
*Attorney, Agent, or Firm*—Bucknam and Archer

[57] ABSTRACT

The method according to the present invention, permits to smooth and polish automatically and semicontinuously slabs of marble, granite and stones of every type while improving substantially the uniformity of smoothing and polishing of the surfaces being worked on and also obtaining substantial increase in the hourly production.

2 Claims, 1 Drawing Sheet

PROCESS FOR AUTOMATICALLY SMOOTHING AND POLISHING SLABS OR MARBLE, GRANITE, STONES AND THE LIKE

The present invention relates to a method of smoothing and polishing slabs of marble, granite or stones in general, automatically and in a discontinuous manner, for the purpose of obtaining uniformity of the product and an increase in the hourly production.

According to the present state of the art, several methods are used for smoothing and polishing any slabs. One of these methods consists of holding the article still on a table while one or more chucks are provided for smoothing and polishing the slab. The chucks, for the purpose of covering the entire surface of the slab, carry out a motion according to a path in the shape of a fret or a zig-zag shape or successive concentric paths.

The main drawback of this method of operation consists of the fact that the apparatus necessary to carry out the method cannot be placed in line with other apparatuses because of the necessity of placing manually the articles being operated on the table, with the result that the hourly production is limited and further, there is the necessity of constantly employing personnel, a fact which substantially increases the cost of operation.

Another known method of operation consists of carrying out the smoothing and the polishing in a continuous manner with the possibility consequently of placing this apparatus in line with others. According to this method, the slab being worked advances on a conveyor belt while a series of chucks mounted on a single beam longitudinally disposed with respect to the direction of advance of the conveyor belt and provided with a motion of advance which is alternating and transversal with respect to the motion of advance of the slab, provide for smoothing and polishing the slab. The slab thus obtained presents areas which have been engaged more or less by the action of the chucks, because of the motion in the shape of a zig-zag of the same chucks and because of the repeated passages of the slab in the central zone with respect to the lateral zones. It follows that the areas being worked present marks of different reflection even if they cannot be picked up except with special measuring instruments.

Further, the central area which has been engaged to a greater extent by the action of the chucks compared with the outer areas, presents a convexity which is limited but which interferes with the perfect planarity of the same slab.

The method according to the present invention eliminates the drawbacks mentioned hereinabove, permits to obtain a slab uniformly polished and with indexes of reflection which are constant along the entire surface of the article being worked, and further provides substantial production increase.

The method according to the present invention consists of employing an apparatus for the smoothing and polishing with a belt along which the slab is caused to advance in a discontinuous manner. When the slab is still in a position, the chucks carry out their transversal motion. When they have travelled along the entire width of the slab, an electromechanical device provides for the advance of the belt and together with it the slab, of a distance equal at the most to the diameter of the tool, that is the chuck, for instance, a distance of 45 cm.

Simultaneously, the movable beam which is disposed longitudinally with respect to the direction of advance of the conveyor belt on which the chucks intended to perform the smoothing and polishing operations are mounted, inverts its motions of travel so that the chucks exert their action of smoothing and polishing on a strip parallel to the strip previously operated on. In this manner, the slab, after the operation has ended, presents a uniform index of reflection and also a perfect planarity. In fact, with the method according to the present invention, there is no area of the slab which is engaged by the smoothing and polishing chucks for a period of time greater as compared with the other areas.

A further advantage of the method according to the present invention resides in the fact that there is an increase of production because the slab, even if it advances at increments, advances with an average speed which is greater with respect to the speed obtained with a continuous motion, under equal resulting esthetic properties.

In fact, in the case of smoothing and polishing with a continuous motion, according to the present state of the art, it is necessary to guarantee that during a complete cycle of motion of the chucks, the slab must advance of a distance not greater than the diameter of a single chuck, and this is required in order to guarantee that the entire surface of the slab is engaged during the operation.

The method according to the present invention permits, without departing from the scope of the invention that the slab advance of a distance which is a multiple or less than the diameter of the tool, for the purpose of engaging to a greater or less extent the slab, thus obtaining uniformity of polishing even with different indexes of reflection. The device for controlling the motion of advance of the belt used to carry out the method according to the present invention may be of the mechanical type or electronic type without departing from the scope of the invention.

For a better understanding of the invention, reference is made according to the drawings of which:

FIG. 1 shows that the apparatus of a known type comprises a movable beam 1 which supports the polishing chucks 2 which in the example shown in the figure are in the number of five, disposed spaced one with respect to the other at a uniform distance but they could also be in a different number and with different distances and they could be grouped in different groups.

The beam 1 is offset transversely with respect to the conveyor belt 3 from one side to the other according to the direction of the double arrow $F_2$ while the slab being worked advances in the direction of the arrow $F_1$.

Figure 1:
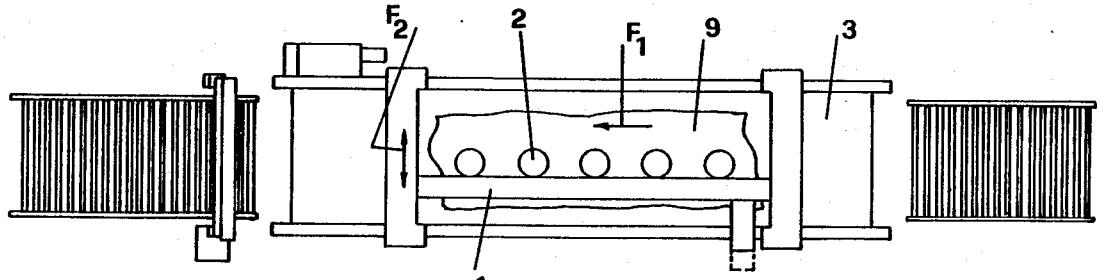
FIG. 1 is an overall top view of a device with a continuous belt used for carrying out the method of the invention.
Figure 2:
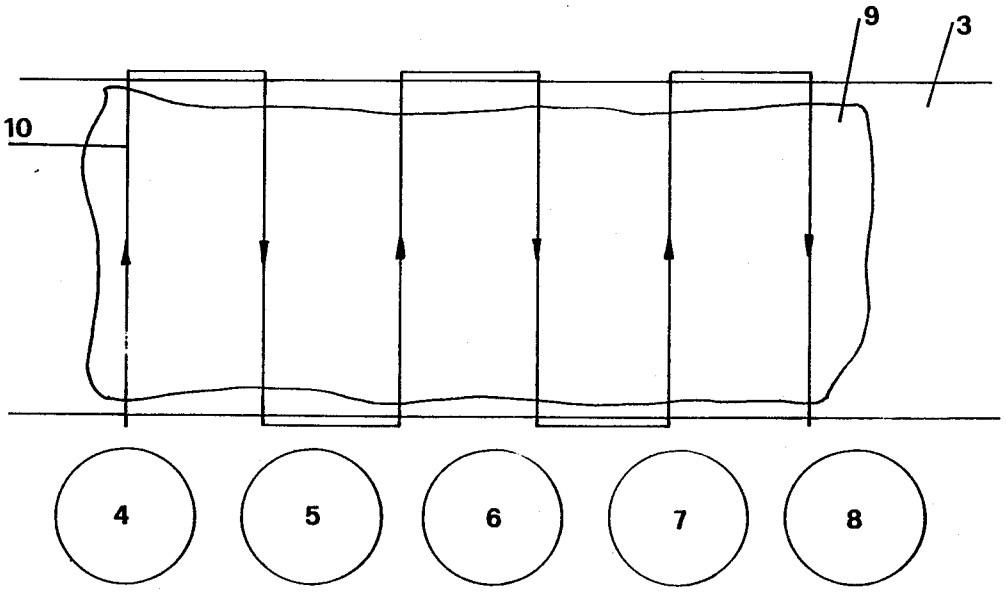
FIG. 2 illustrates schematically the positions of the chucks during the several phases of operation.

FIG. 2 illustrates five chucks numbered 4–8 under which advances the slab being worked designated by numeral 9 and which is carried by the conveyor belt 3. Numeral 10 in solid lines designates schematically the path carried out by the chuck 4 with respect to the slab 9 being worked, a path which results in the shape of fret.

In this particular case the advance of the belt 3 is less than the engagement between the same chucks. It follows that the chucks during the motion of advance opposite to the previous motion, smooth and polish an area which is parallel but which is not completely superimposed to the area smoothed and polished by the subsequent chucks during the preceding advance motion. In this manner, it is possible to achieve a uniform smoothing of the surface of the entire slab.

The path has been designated by way of example and is not intended to limit the invention because the position of the chucks and also the number of the chucks, as well as the rate of advance of the belt may assume different values depending upon the particular type of material being worked without departing from the scope of the invention.

What is claimed is:

1. In a method of automatically smoothing and polishing a slab of marble, granite, stone or the like (9) by means of an apparatus which comprises a conveyor belt (3) for the slab, a plurality of chucks (2) supported by a movable beam (1), said chucks having a diameter, said beam being disposed longitudinally with respect to the direction of advance of the belt and being capable of inverting the direction of its motion, said chucks carrying out a transversal and alternating motion with respect to the direction of advance of the slab, and controlling means for controlling the advance of said belt, the improvement which consists of advancing said slab on said conveyor belt in a discontinuos manner, and when said slab (9) is still, the beam (1) which carried said chucks (2), performs its transversal motion, polishing a first area of said slab over the entire width of the slab with the chucks advancing said slab a predetermined amount with respect to the diameter of said chucks (2), halting polishing during the advance of the slab, halting the advance of the slab, polishing the slab by inverting the transversal motion of the beam across the slab, while the slab is still, said chucks operate on a second area of said slab (9), said second area being parallel to the first area, repeating the above steps until the slab is completed such that the chucks carry out a fret motion, and uniform polishing is achieved while obtaining an increase in the hourly production with equal esthetic properties.

2. The method according to claim 1, wherein said controlling means for the advance of said belt (3) which carries said slab (9) being worked causes said belt to advance of a distance which is a multiple or less than the diameter of said chuck whereby uniform polishing of said slab is obtained even with different indexes of reflection.

* * * * *